US005853126A

United States Patent [19]

Alexander

[11] Patent Number: 5,853,126

[45] Date of Patent: Dec. 29, 1998

[54] QUICK DISCONNECT FOR POWDER COATING APPARATUS

[75] Inventor: Kevin L. Alexander, Brownsburg, Ind.

[73] Assignee: Illinois Tool Works, Inc., Glenview, Ill.

[21] Appl. No.: 795,066

[22] Filed: Feb. 5, 1997

[51] Int. Cl.[6] ..... B05B 5/00; B05B 3/10

[52] U.S. Cl. ..... 239/223; 239/224; 239/700; 239/703; 239/704

[58] Field of Search ..... 239/223, 224, 239/700, 701, 703, 704; 285/124.3, 124.4, 124.5, 349

[56] References Cited

U.S. PATENT DOCUMENTS

| | | | |
|---|---|---|---|
| 3,125,361 | 3/1964 | Weaver | 285/349 X |
| 3,263,127 | 7/1966 | Point et al. . | |
| 3,536,514 | 10/1970 | LaFave et al. . | |
| 3,746,348 | 7/1973 | Stone | 285/349 X |
| 3,870,232 | 3/1975 | Lacchia . | |
| 4,024,815 | 5/1977 | Platsch . | |
| 4,037,561 | 7/1977 | LaFave et al. . | |
| 4,114,564 | 9/1978 | Probst . | |
| 4,116,384 | 9/1978 | Lacchia . | |
| 4,232,832 | 11/1980 | De Fusco . | |
| 4,235,381 | 11/1980 | Vila . | |
| 4,381,079 | 4/1983 | Allen . | |
| 4,447,008 | 5/1984 | Allen . | |
| 4,788,933 | 12/1988 | Buschor . | |
| 4,993,645 | 2/1991 | Buschor . | |
| 4,997,130 | 3/1991 | Weinstein | 239/700 X |
| 5,022,590 | 6/1991 | Buschor . | |
| 5,240,185 | 8/1993 | Kaiju et al. . | |
| 5,323,547 | 6/1994 | Kaiju et al. . | |
| 5,335,828 | 8/1994 | Kaiju et al. . | |
| 5,353,995 | 10/1994 | Chabert . | |
| 5,433,387 | 7/1995 | Howe et al. . | |
| 5,632,448 | 5/1997 | Alexander et al. . | |
| 5,633,306 | 5/1997 | Howe et al. . | |
| 5,697,559 | 12/1997 | Davis et al. | 239/703 |
| 5,704,977 | 1/1998 | Baumann et al. | 239/223 X |

FOREIGN PATENT DOCUMENTS

| | | |
|---|---|---|
| 2 605 533 | 4/1988 | France . |
| 24 46 022 | 4/1976 | Germany . |
| 28 37 428 | 3/1979 | Germany . |

OTHER PUBLICATIONS

Aerobell™ Powder Applicator ITW Automatic Division.
Aerobell™ & Aerobell Plus™ Rotary Atomizer, DeVilbiss Ransburg Industrial Liquid Systems.

*Primary Examiner*—Andres Kashnikow
*Assistant Examiner*—Robin O. Evans
*Attorney, Agent, or Firm*—Barnes & Thornburg

[57] ABSTRACT

A coating dispensing head includes a rotary dispensing device, a rotator for rotating the rotary dispensing device and a tachometer for generating a light signal in response to rotation of the rotator. The head includes a first connection for supplying the coating to the dispensing device, a second connection for supplying motive power to the rotator and a first optical fiber having a first end for receiving the light signal and a second end. At least one of the first and second connections includes first and second passageways terminating at respective first and second generally flat surfaces and connectors for holding the first and second surfaces against each other with the first and second passageways aligned so that the one of coating and motive power supplied to one of the first and second passageways flows into the other of the first and second passageways and thence to the one of the dispensing device and rotator. The second end of the first optical fiber conducts the light signal to one of the first and second surfaces. Third and fourth passageways are provided in the first and second surfaces. The connectors hold the first and second surfaces against each other with the third and fourth passageways aligned. A first retainer is provided for retaining the second end of the optical fiber in a fixed location adjacent the one of the first and second surfaces. A light receiver is provided for receiving the light signal from the second end of the optical fiber. A second retainer is provided for retaining the light receiver in a fixed location adjacent the other of the first and second surfaces.

9 Claims, 10 Drawing Sheets

QUICK DISCONNECT FOR POWDER COATING APPARATUS

BACKGROUND OF THE INVENTION

This invention relates to coating material dispensing systems. It is disclosed in the context of a dispensing system for fluidized powder coatings, but is believed to have utility in other applications as well.

Coating dispensing systems, for example, those which use electrostatically aided rotary atomization and dispensing techniques, frequently employ fiber optic couplings for, for example, atomizer rotator speed control to feed back to (a) controller(s) information regarding the rotation rates of their rotators. Fiber optic speed control systems are particularly useful in such applications because they obviate additional electrical conductors extending from the rotary atomizer back to a controller to close the speed control feedback loop. Optical fibers and their sheathing can be made practically as electrically non-conductive as is necessary or desirable to prevent the high-magnitude potentials which typically are present on at least certain components of such rotators from finding pathways to ground through elements of the fiber optic feedback loop.

Such systems also typically include connections for such services as coating material, for example, fluidized coating powder, compressed air, and so on.

However, a problem occurs in such systems when it is necessary or desirable to remove one such rotator from service, for example, for general maintenance or repair, and replace it with another similar rotator. At these times, time-consuming reconnection of these services, including realignment of the terminals of the optical fibers which make up the various sections of the feedback loop, is required. Realignment of the terminals of the optical fibers is required, for example, in order to reduce the attenuation of the feedback speed signal at junctions among the sections of the feedback loop. Typically there is at least one such junction, that being at the back end of the rotator itself. Having a junction at this location is desirable to avoid a long exposed section of optical fiber dangling out either from the back of the rotator or the front of the rotator mounting.

SUMMARY OF THE INVENTION

This invention addresses the problem of improving and making less time-consuming the alignment of this interface.

According to one aspect of the invention, a coating dispensing head includes a rotary dispensing device and a rotator for rotating the rotary dispensing device. The head includes a first connection for supplying the coating to the dispensing device and a second connection for supplying motive power to the rotator. At least one of the first and second connections includes first and second passageways terminating at respective first and second generally flat surfaces and connectors for holding the first and second surfaces against each other with the first and second passageways aligned so that the one of coating and motive power supplied to one of the first and second passageways flows into the other of the first and second passageways and thence to the one of the dispensing device and rotator.

Illustratively, the apparatus further comprises a tachometer for generating a light signal in response to rotation of the rotator, and a first optical fiber having a first end for receiving the light signal and a second end for conducting the light signal to one of the first and second surfaces. Third and fourth passageways are provided in the first and second surfaces. The connectors hold the first and second surfaces against each other with the third and fourth passageways aligned. A first retainer is provided for retaining the second end of the optical fiber in a fixed location adjacent the one of the first and second surfaces. Means are provided for receiving the light signal from the second end of the optical fiber. A second retainer is provided for retaining the receiving means in a fixed location adjacent the other of the first and second surfaces.

Additionally illustratively, the coating is a pulverulent coating material, the rotary dispensing device is a dispenser for fluidized pulverulent coating material and the rotator is a compressed gas driven turbine rotator. The first connection includes the first and second passageways for supplying fluidized pulverulent coating material to the dispenser. The second connection includes third and fourth passageways terminating at the first and second surfaces, respectively. The connectors hold the first and second surfaces against each other with the third and fourth passageways aligned so that compressed gas supplied to one of the third and fourth passageways flows into the other of the third and fourth passageways and thence to the compressed gas driven turbine rotator.

Further illustratively, a first groove is provided in one of the first and second surfaces around a respective one of the first and second passageways for accommodating a first O-ring to assist in sealing the first and second passageways to each other at the mating first and second surfaces.

Additionally illustratively, a second groove is provided in one of the first and second surfaces around a respective one of the third and fourth passageways for accommodating a second O-ring to assist in sealing the third and fourth passageways to each other at the mating first and second surfaces.

According to another aspect of the invention, a coating dispensing head includes a rotary dispensing device and a rotator for rotating the rotary dispensing device. The head includes a first connection for supplying the coating to the dispensing device and a second connection for supplying motive powder to the rotator. A tachometer generates a light signal in response to rotation of the rotator. A first optical fiber has a first end for receiving the light signal and a second end for conducting the light signal to one of first and second generally flat surfaces. First and second passageways are provided in the first and second surfaces. Connectors are provided for holding the first and second flat surfaces against each other with the first and second passageways aligned. A first retainer is provided for retaining the second end of the optical fiber in a fixed location adjacent one of the first and second surfaces. Means are provided for receiving the light signal from the second end of the optical fiber. A second retainer is provided for retaining the receiving means in a fixed location adjacent the other of the first and second surfaces to receive the light signal from the second end of the first optical fiber when the connectors are holding the first and second surfaces against each other.

Illustratively according to this aspect of the invention, the rotary dispensing device is a dispenser for fluidized pulverulent coating material and the rotator is a compressed gas driven turbine rotator.

BRIEF DESCRIPTION OF THE DRAWINGS

The invention may best be understood by referring to the following detailed description and accompanying drawings which illustrate the invention. In the drawings.

DETAILED DESCRIPTION OF AN ILLUSTRATIVE EMBODIMENT

Figure 1:
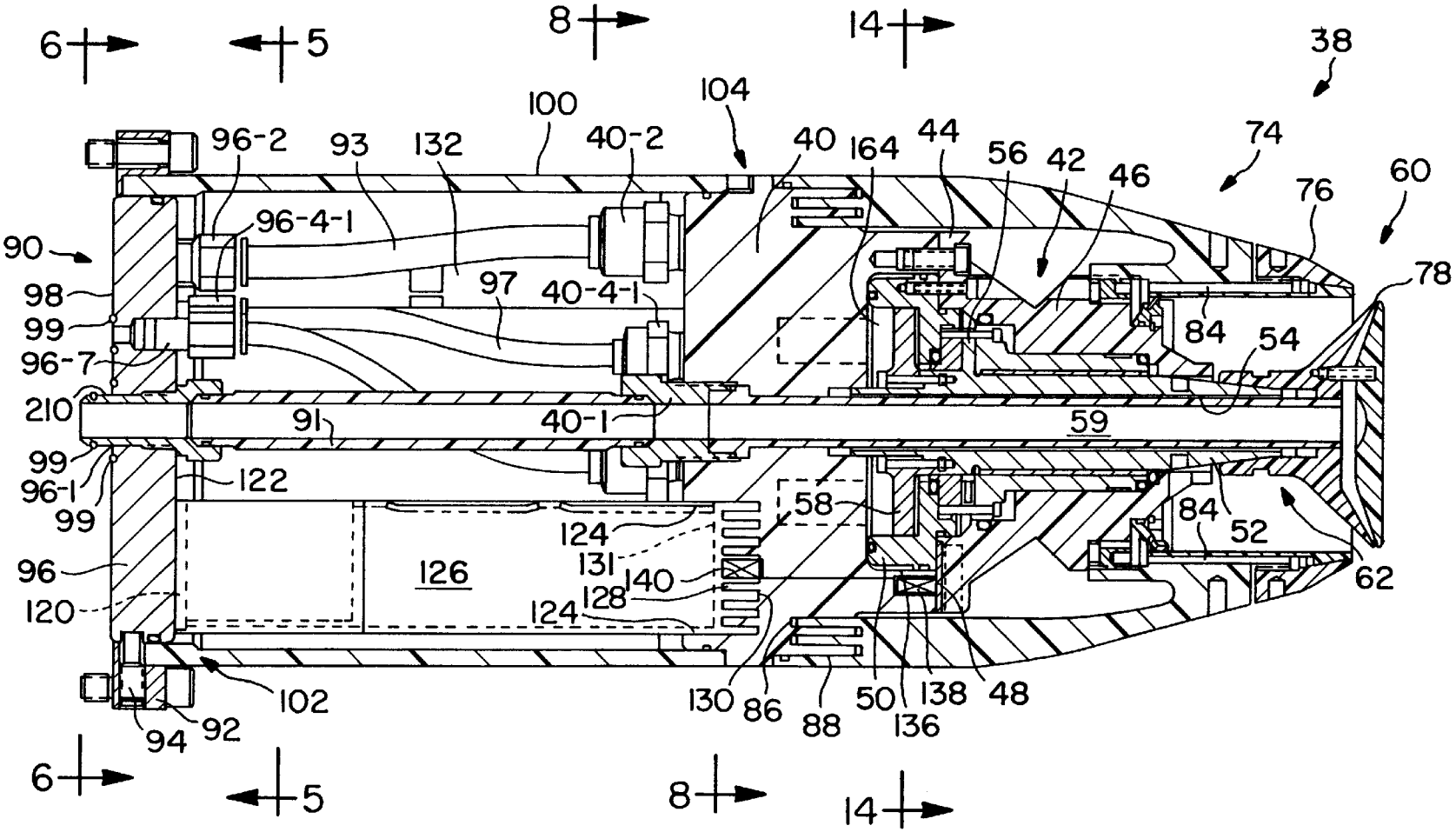
FIG. 1 illustrates a longitudinal sectional view through a powder dispenser embodying the present invention.
Figure 2:
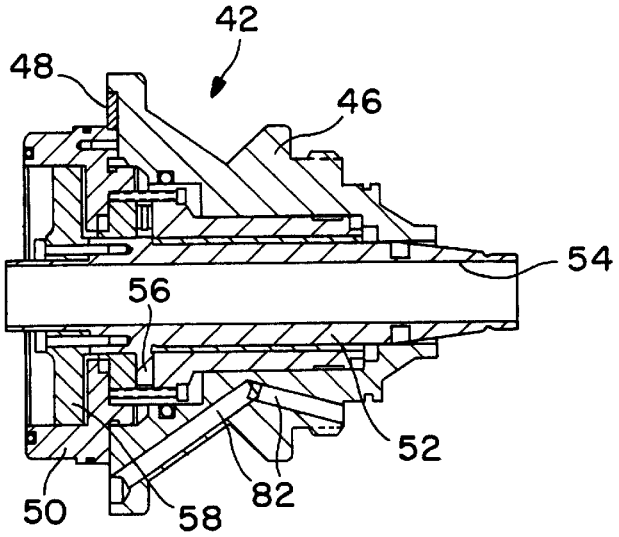
FIG. 2 illustrates another longitudinal sectional view through a detail of the powder dispenser illustrated in FIG. 1.
Figure 3:
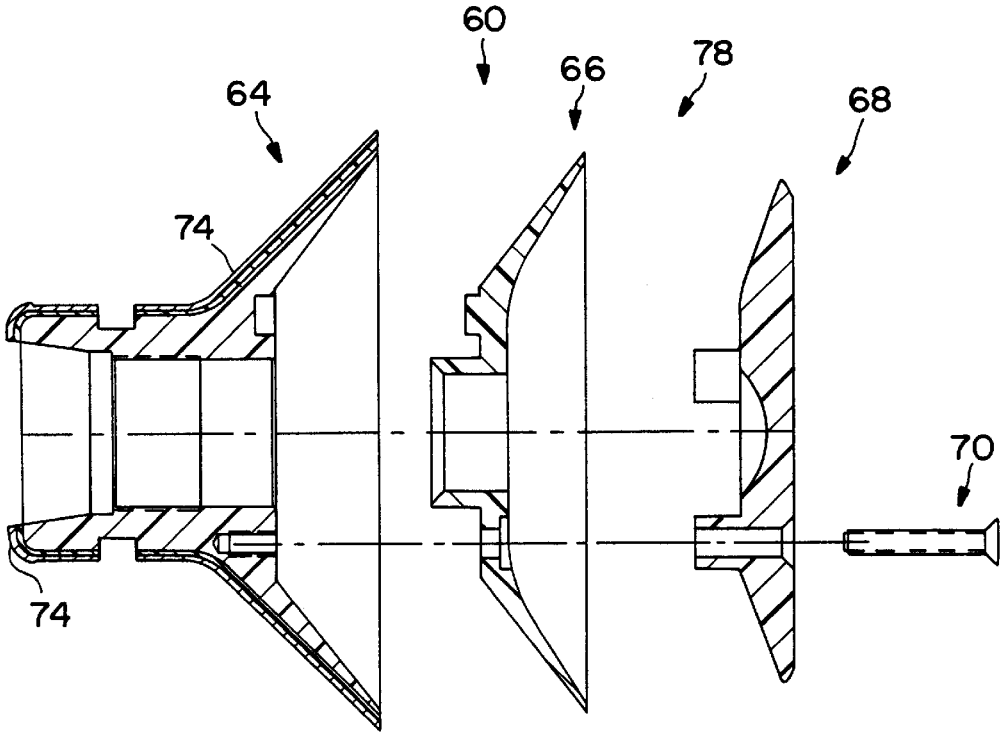
FIG. 3 illustrates an exploded longitudinal sectional view through a detail of the powder dispenser illustrated in FIG. 1.
Figure 4:
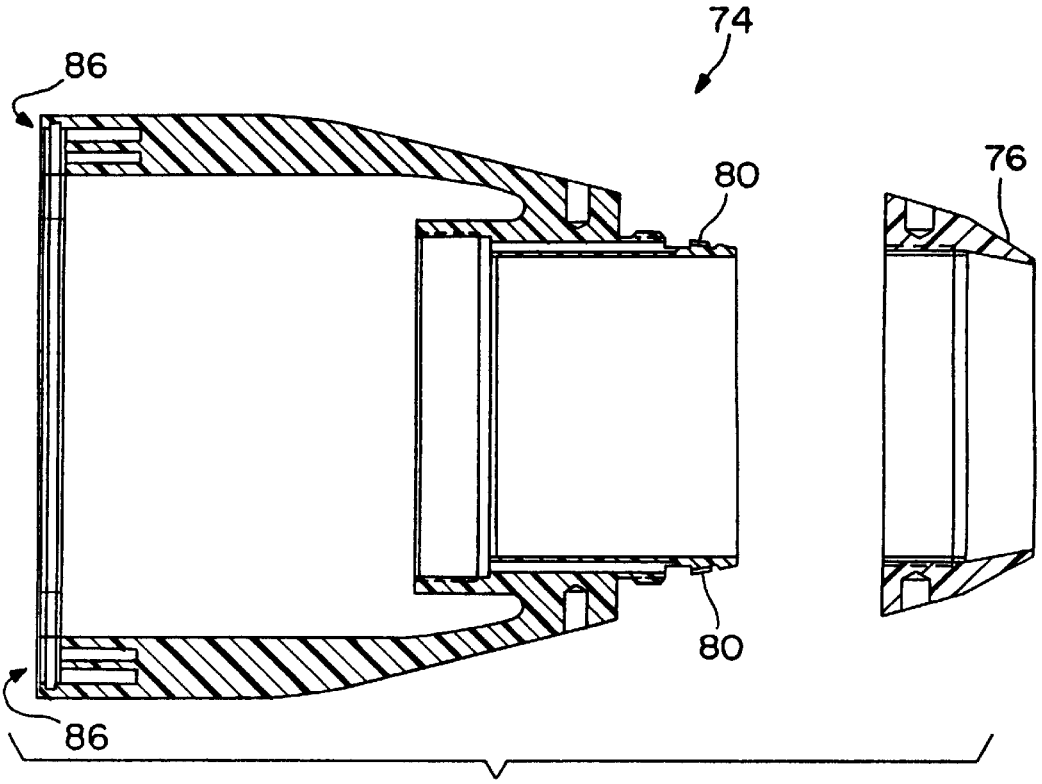
FIG. 4 illustrates an exploded longitudinal sectional view through a detail of the powder dispenser illustrated in FIG. 1.
Figure 4A:
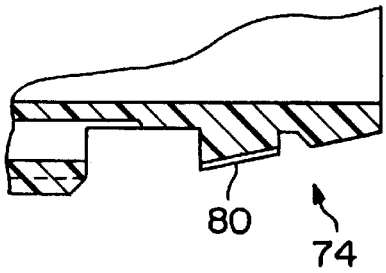
FIG. 4*a* illustrates an enlarged fragmentary view of a detail of FIG. 4.
Figure 5:
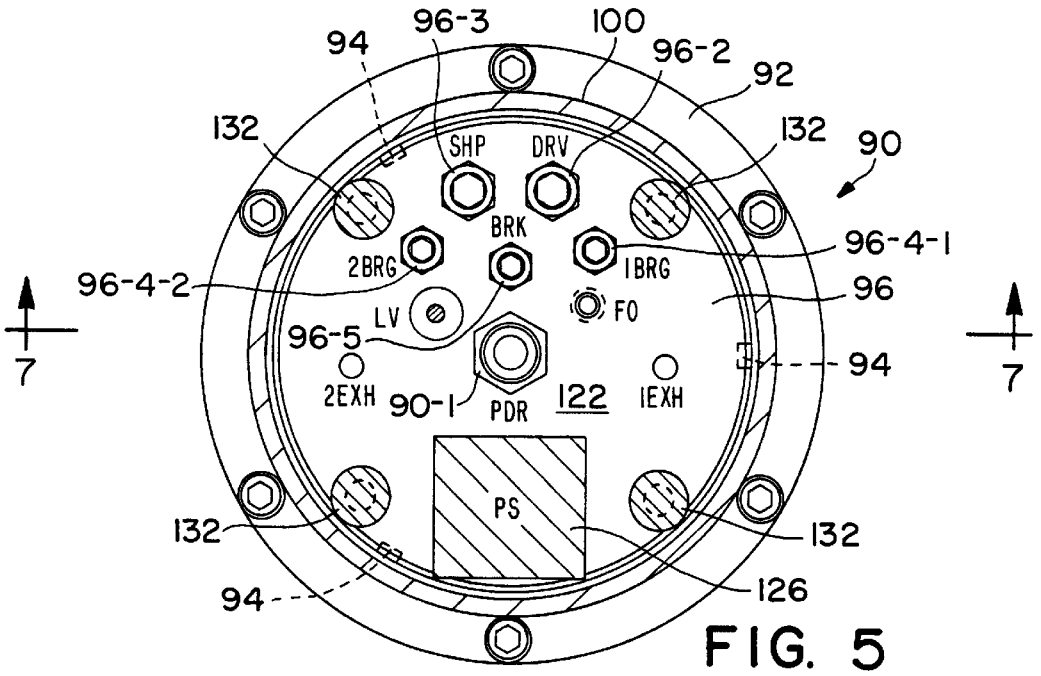
FIG. 5 illustrates a sectional view through the powder dispenser illustrated in FIG. 1, taken generally along section lines 5—5 of FIG. 1.
Figure 6:
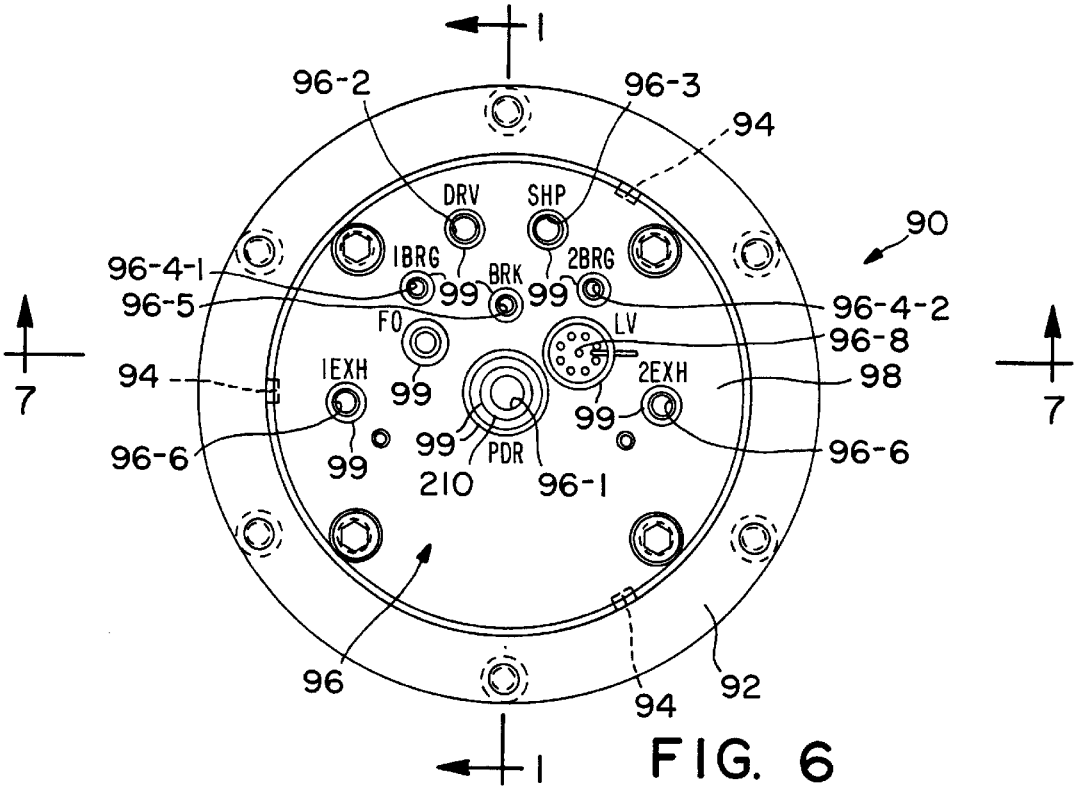
FIG. 6 illustrates a view of the powder dispenser illustrated in FIG. 1, taken generally along section lines 6—6 of FIG. 1.
Figure 7:
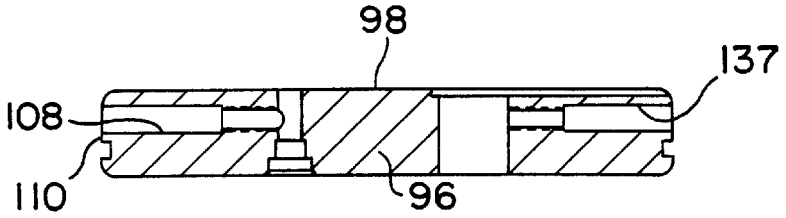
FIG. 7 illustrates a sectional view through a detail of the powder dispenser illustrated in FIG. 1, taken generally along section lines 7—7 of FIGS. 5–6.
Figure 8:
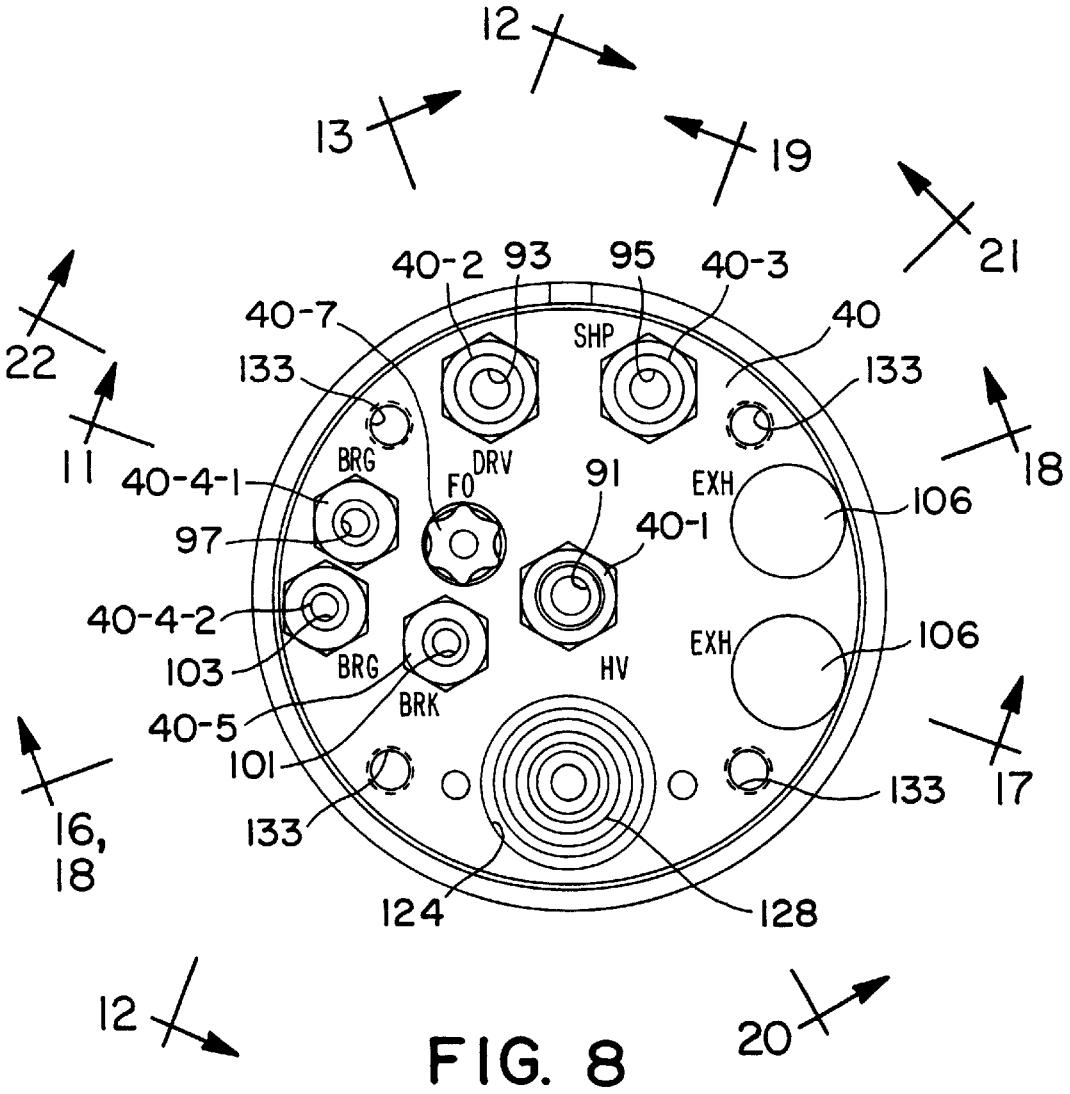
FIG. 8 illustrates a sectional view through the powder dispenser illustrated in FIG. 1, taken generally along section lines 8—8 of FIG. 1.
Figure 9:
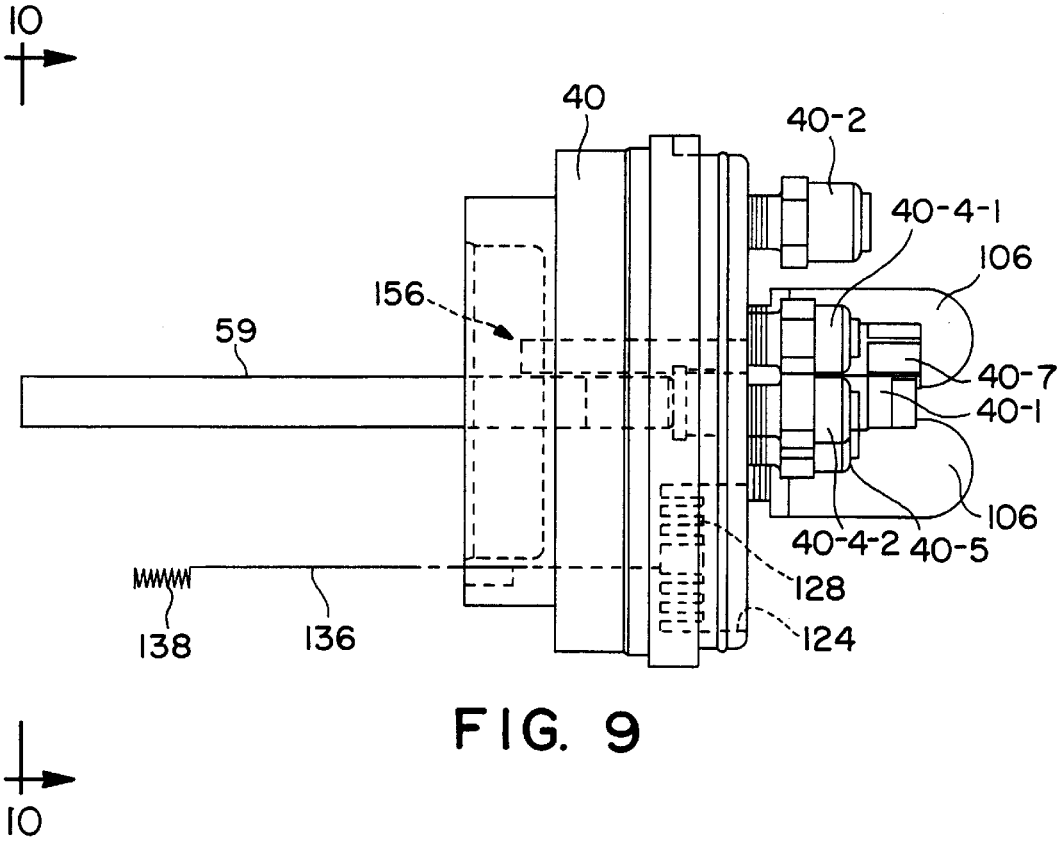
FIG. 9 illustrates a side elevational view of certain details of the powder dispenser illustrated in FIG. 1.
Figure 10:
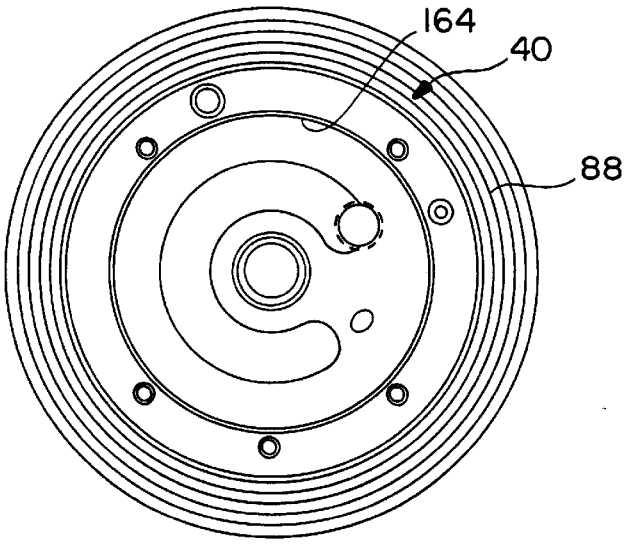
FIG. 10 illustrates a view of the details of the powder dispenser illustrated in FIG. 9, taken generally along section lines 10—10 of FIG. 9.
Figure 11:
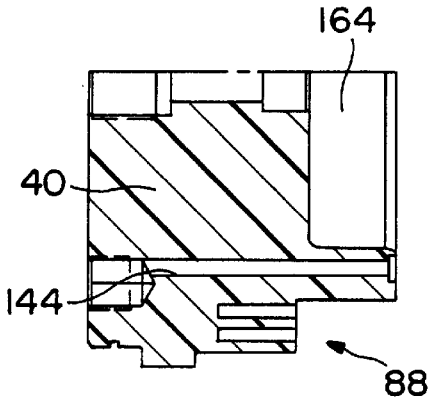
FIG. 11 illustrates a fragmentary sectional view through a detail of the powder dispenser illustrated in FIG. 1, taken generally along section line 11 and the axis of FIG. 8.
Figure 12:
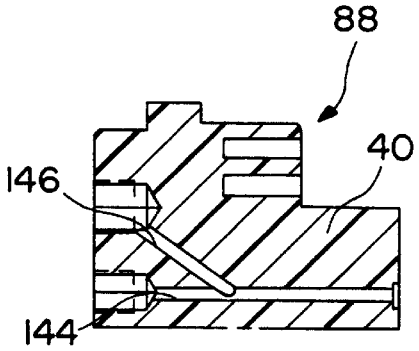
FIG. 12 illustrates a fragmentary sectional view through a detail of the powder dispenser illustrated in FIG. 1, taken generally along section line 12 and the axis of FIG. 8.
Figure 13:
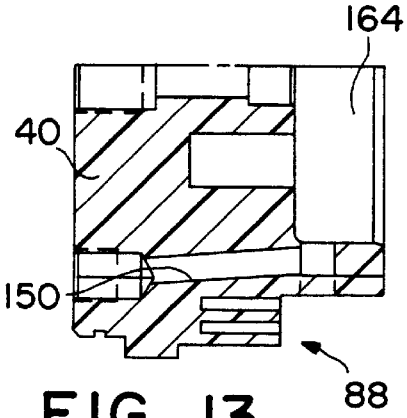
FIG. 13 illustrates a fragmentary sectional view through a detail of the powder dispenser illustrated in FIG. 1, taken generally along section line 13 and the axis of FIG. 8.
Figure 16:
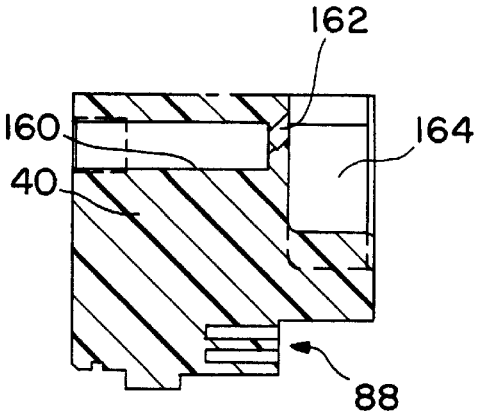
FIG. 16 illustrates a fragmentary sectional view through a detail of the powder dispenser illustrated in FIG. 1, taken generally along section line 16 and the axis of FIG. 8.
Figure 14:
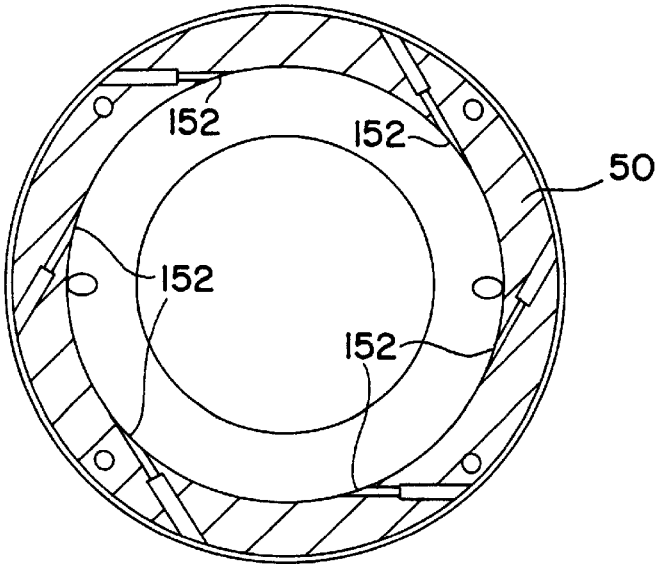
FIG. 14 illustrates a sectional view through a detail of the powder dispenser illustrated in FIG. 1, taken generally along section lines 14—14 of FIG. 1.
Figure 15:
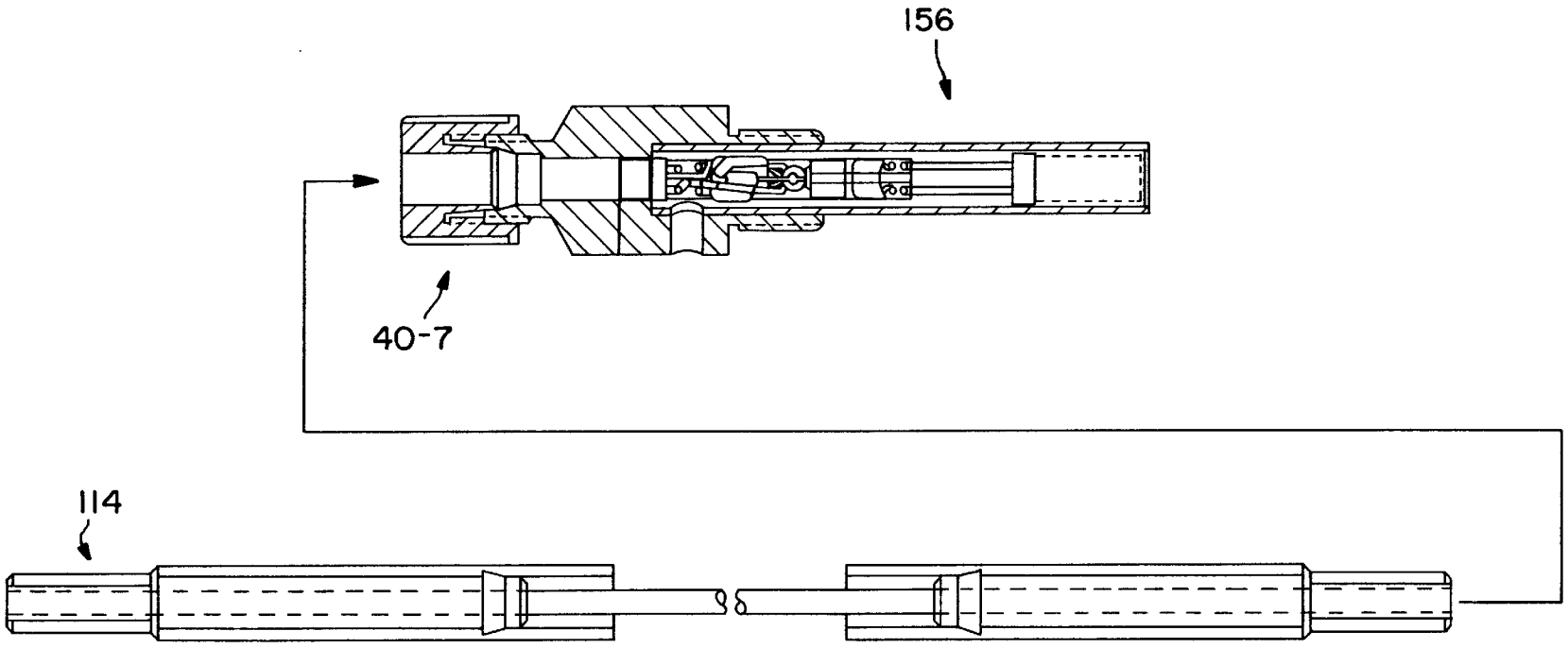
FIG. 15 illustrates a fragmentary, exploded, partial longitudinal sectional view of a detail of the powder dispenser illustrated in FIG. 1.
Figure 17:
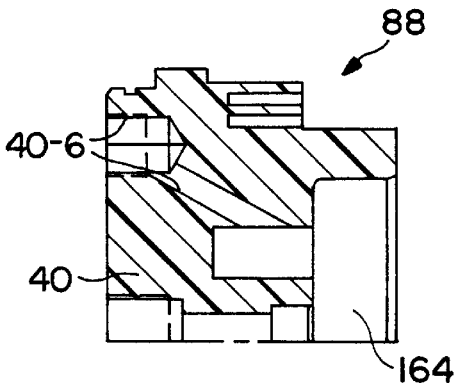
FIG. 17 illustrates a fragmentary sectional view through a detail of the powder dispenser illustrated in FIG. 1, taken generally along section line 17 and the axis of FIG. 8.
Figure 18:
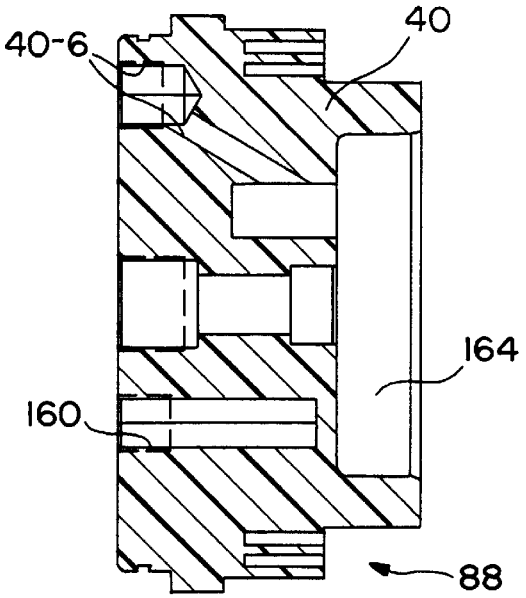
FIG. 18 illustrates a fragmentary sectional view through a detail of the powder dispenser illustrated in FIG. 1, taken generally along section lines 18—18 of FIG. 8.
Figure 19:
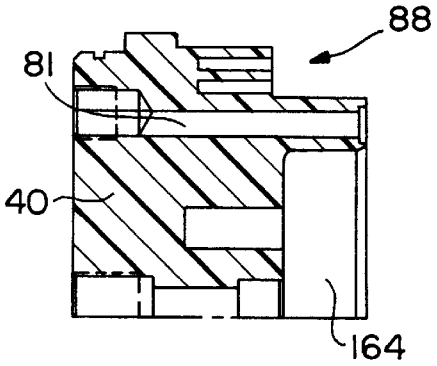
FIG. 19 illustrates a fragmentary sectional view through a detail of the powder dispenser illustrated in FIG. 1, taken generally along section line 19 and the axis of FIG. 8.
Figure 20:
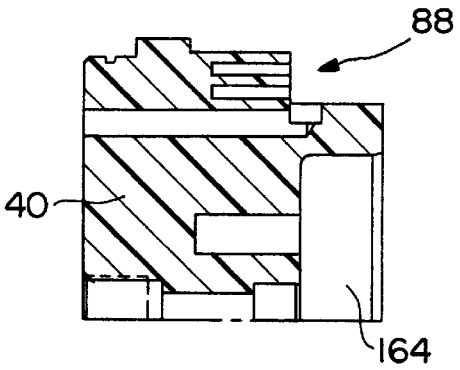
FIG. 20 illustrates a fragmentary sectional view through a detail of the powder dispenser illustrated in FIG. 1, taken generally along section line 20 and the axis of FIG. 8.
Figure 21:
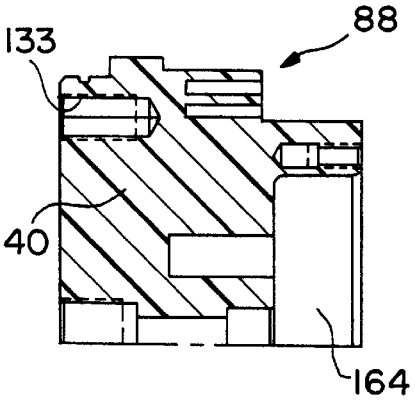
FIG. 21 illustrates a fragmentary sectional view through a detail of the powder dispenser illustrated in FIG. 1, taken generally along section line 21 and the axis of FIG. 8.
Figure 22:
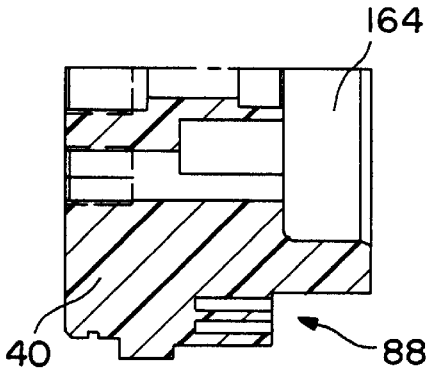
FIG. 22 illustrates a fragmentary sectional view through a detail of the powder dispenser illustrated in FIG. 1, taken generally along section line 22 and the axis of FIG. 8.

A rotary powder dispenser 38 according to the invention includes a manifold 40. Manifold 40 illustratively is constructed from, for example, Acetron® GP general purpose acetal available from DSM Engineering Plastic Products, Incorporated, Reading, Pa. 19612-4235. An air turbine motor assembly 42 is mounted from a front side 44 of manifold 40 and extends forward therefrom. Motor assembly 42 includes a turbine motor housing 46 constructed from, for example 150SA or 550SA Delrin® material, a high voltage contact plate 48 constructed from, for example, aluminum, a turbine air nozzle plate 50 constructed from, for example, aluminum, an air turbine shaft 52 having a central axial passageway 54 therethrough, a thrust bearing spacer 56 and a turbine rotor 58. The turbine motor assembly 42 can be, for example a part D1245-07 available from Westwind Air Bearings, Inc., 745 Phoenix Drive, Ann Arbor, Mich. 48108. A, for example, glass reinforced Delrin® feed tube 59 extends down the center of passageway 54.

A powder bell cup assembly 60 is threaded onto front end 62 of shaft 52. Powder bell cup assembly 60 includes a bell cup 64 constructed from, for example, filled or unfilled polyetheretherketone (PEEK), a bell cup insert or liner 66 constructed from, for example, Teflon® or Delrin® material, and a diffuser 68 also constructed from, for example, Teflon® or Delrin® material, all held together by three equally circumferentially spaced slotted flat head screws 70. Diffuser 68 illustratively is configured as illustrated and described in U.S. Ser. No. 08/377,816 filed Jan. 25, 1995, now U.S. Pat. No. 5,632,448. The outer surfaces 74 of bell cup 64 are treated as described in U.S. Ser. No. 08/451,570 filed May 26, 1995, now U.S. Pat. No. 5,662,278, U.S. Ser. No. 08/437,218 filed May 8, 1995, now U.S. Pat. No. 5,633,306 and U.S. Ser. No. 08/451,541 filed May 26, 1995, now U.S. Pat. No. 5,622,563. These four applications are incorporated herein by reference. The material from which bell cup 64 is constructed accepts the above-identified treatment of its outside surfaces 74 well. The material from which the liner 66 is constructed has somewhat less susceptibility to impact fusion of many coating powders of the type being dispensed by dispenser 38.

A somewhat projectile-shaped front shroud 74 having a shaping air ring cap 76 houses the forward part of manifold 40, turbine motor assembly 42, and most of powder bell cup assembly 60 except the forwardmost portions thereof, including the powder discharge slot 78 defined between liner 66 and diffuser 68. Radially outwardly and axially extending ribs 80 provided on shroud 74 help define between shroud 74 and shaping air-ring cap 76 an annular shaping air slot which is provided with shaping air through passageways 81, 82, 84 provided in manifold 40, turbine housing 46, and front shroud 74, respectively. The complementary, mating surfaces 86, 88 of shroud 74 and manifold 40 are labyrinthine in configuration to provide longer pathways across the surfaces of these two components. This reduces the likelihood of tracking of the high magnitude electrical potential which is impressed upon, for example, high voltage contact plate 48 during operation of dispenser 38 back to, for example, grounded dispenser 38 support.

A rear manifold plate assembly 90 includes a rear manifold mounting flange 92 attached by three equally circumferentially spaced screws 94 to a rear manifold mounting plate 96. The rearward surface 98 of plate 96 is finished flat and smooth. A generally right circular cylindrical rear shroud 100 is captured at its rearward extent in an annular groove 102 provided by adjacent surfaces of plate 96 and flange 92 and at its forward extent in an annular groove 104 provided on the rearwardly facing side of manifold 40. Appropriate fittings and lines connect the respective fluidized PowDeR (fittings 96-1 and 40-1 and line 91), powder cloud SHaPing air (fittings 96-3 and 40-3 and line 95), turbine DRiVing air (fittings 96-2 and 40-2 and line 93), turbine BeaRinG air 1 and 2 (fittings 96-4-1, 96-4-2, 40-4-1 and 40-4-2 and lines 97 and 103) and turbine BRaKing air ports (fittings 96-5 and 40-5 and line 101) on plate 96 and manifold 40. Turbine air EXHaust ports 1 and 2 (ports 96-6) in plate 96 vent turbine exhaust air from within rear shroud 100. This air is exhausted from turbine 42 through mufflers 106 fitted to the two EXHaust ports (40-6) on manifold 40.

FiberOptic speed control fittings (40-7 and 96-7) are provided on both manifold 40 and plate 96. The FiberOptic speed control fitting 96-7 on plate 96 is intersected by a threaded bore 108 which extends into plate 96 from its edge 110. A cap screw is threaded into bore 108 to provide for the precise location of an optical fiber terminal 114 at the flat surface 98 of plate 96. This facilitates matching of the optical fiber terminal 114 to a lens mounted in a flat plate onto which plate 96 is mounted by bolts 116 for quick and easy replacement. This mechanism avoids the time consuming necessity of aligning terminal 114 with the lens if dispenser 38 should have to be removed for any reason including replacement by a similarly designed dispenser. The fluidized PowDeR (96-1), powder cloud SHaPing air (96-3), turbine DRiVing (air 96-2), turbine BeaRinG air (96-4-1 and 96-4-2) and turbine BRaKing air (96-5) ports on surface 98 are provided with surrounding O-ring seals 99.

A generally right rectangular cylindrical boss 120 is provided on the forward or inside surface 122 of plate 96. A generally right circular cylindrical relief 124 is provided on the rearward surface of manifold 40 directly opposite boss 120. An ITW Ransburg MICRO-PAK high voltage transformer and cascade-type voltage multiplier 126 is captured between boss 120 and relief 124. The floor 128 of relief 124 is labyrinthine to complement the configuration of high magnitude potential output end 130 of high voltage multiplier 126. Again, this configuration provides longer pathways across the surfaces of multiplier 126 and manifold 40 from the high magnitude potential terminal 131 of multiplier 126 to ground. Manifold 40, turbine motor assembly 42 and front shroud 74 are supported from rear manifold plate 96 by four equally circumferentially spaced support rods 132 which have threaded ends for threading into complementarily threaded holes 133 provides therefor in manifold 40. Support rods 132 are attached to plate 96 by cap screws 135.

Bearing air is supplied to the turbine 42 air bearing through the 1 BRG port. The 2 BRG port couples the air bearing to a pressure sensing switch, not shown. If the switch senses the loss of pressure in the air bearing, the flows of fluidized powder coating material and driving air are halted and the turbine 42 is permitted to coast to a stop in an effort to save the turbine 42.

Low alternating current voltage, for example 12VAC-30VAC, is supplied through the LowVoltage connector 96-8 on plate 96 to the low voltage terminals of multiplier 126. LowVoltage connector 96-8 is also held in place by a cap screw (not shown) threaded into a bore 137 in the edge 110 of plate 96. Bore 137 intersects the bore into which connector 96-8 is fitted. A, for example, phosphor bronze, wire 136 has several coils of compression spring 138 formed at one end thereof. The end 140 of wire 136 opposite spring 138 fits into the cavity in multiplier 126 in which terminal 131 is provided. The spring 138 is compressed in contact with high voltage contact plate 48 during assembly of turbine 42 to manifold 40.

BeaRinG air for turbine 42 is supplied from fitting 40-4-1 through passageways 144 to the air bearing 145 of turbine 42. This bearing air is sensed through passageways 146 by the above mentioned air BeaRinG pressure sensing switch connected to fitting 40-4-2. If BeaRinG air pressure is present at fitting 40-4-2, DRiVing air for turbine 42 flows forward through fitting 40-2 and passageways 150 from which it flows through the turbine 42 nozzles 152 and against the blades of the turbine rotor 58 to rotate rotor 58 and the powder bell cup assembly 60 mounted on the end 62 of shaft 52.

Turbine 42 rotation rate signals are coupled back through, for example, a DeVilbiss Ransburg model LSMC 5003 inductive-to-fiber optic signal transmitter 156 which generates a pulse of light each time it senses the passage of a small magnetic disk (not shown) mounted in the rearwardly facing surface of rotor 58 facing transmitter 156. This signal is transmitted through fiber optic coupler 114 to surface 98 of plate 96 for further transmission through, for example, another similar fiber optic coupler (not shown) to turbine 42 speed control equipment (not shown) which controls the supply of DRiVing air to fitting 96-2, thereby controlling the turbine 42 rotation rate.

BRaKing air to slow the turbine 42 rotation rate is supplied from fitting 40-5 through passageways 160 to a braking air nozzle 162 which directs braking air, when it is supplied to fitting 40-5 at braking air buckets formed in the rearwardly facing surface of rotor 58.

Exhaust air from the low pressure side 164 of turbine 42 is exhausted through passageways 40-6 and mufflers 106 into rear shroud 100. From shroud 100, the exhaust air is vented through the 1 EXHaust and 2 EXHaust ports in plate 96. In this way, the turbine 42 exhaust is conducted in a direction away from the area radially directly outwardly from slot 78 where the dispensed powder cloud is formed and sustained, rather than being exhausted in a direction generally toward the powder cloud.

The powder cloud is shaped by SHaPing air supplied through fitting 96-3, line 95, fitting 40-3 and passageways 81, 82 and 84.

Figure 23:
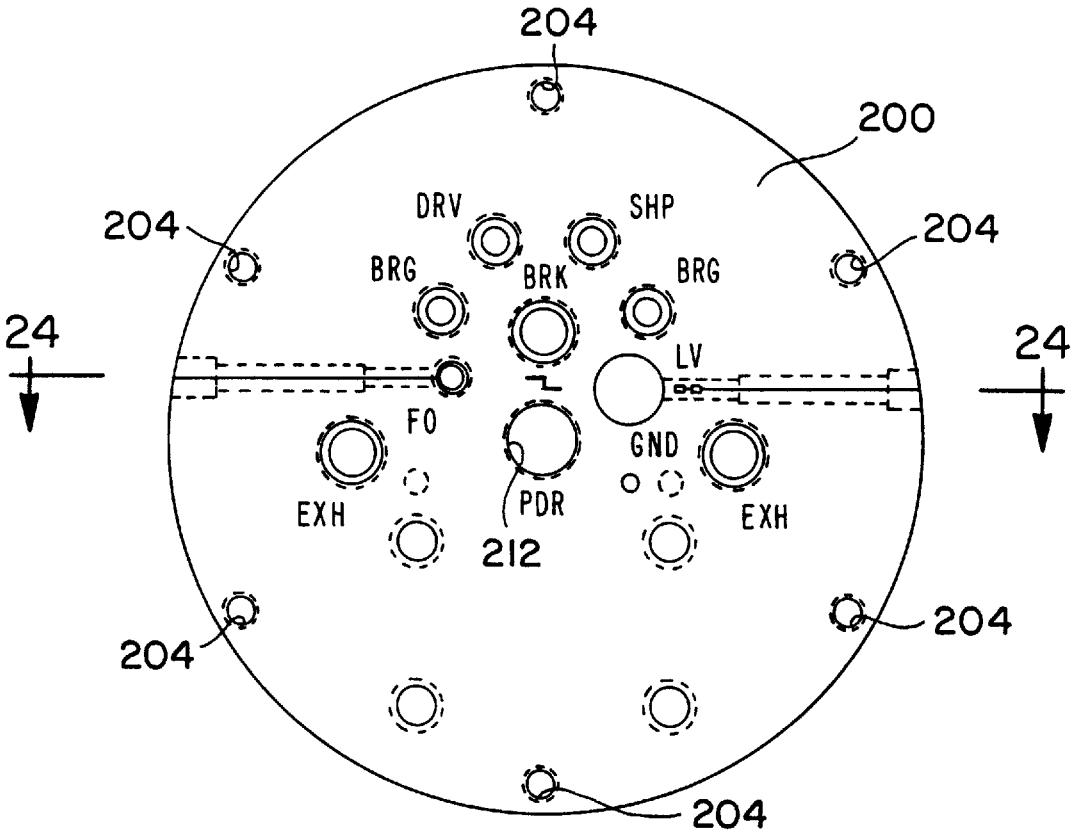
FIG. 23 illustrates an elevational view of a mounting plate for mounting the powder dispenser illustrated in FIG. 1; and, FIG. 24 illustrates a sectional view through the mounting plate illustrated in FIG. 23, taken generally along section lines 24—24 of FIG. 23.
Figure 24:
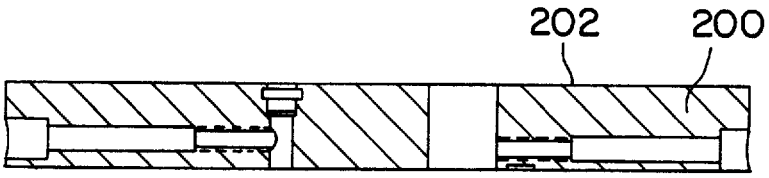

Referring now to FIGS. 23–24, a mating plate 200 has a flat forward surface 202 facing the rearward surface 98 of plate 96. Threaded openings 204 are circumferentially equally spaced around surface 202 for receiving cap screws 206 in flange 92. Tightening of cap screws 206 in openings 204 compresses the O-rings 99 between surfaces 98 and 202 around mating fluidized PowDeR, DRiVing air, SHaPing air, BeaRinG air 1 and 2, BRaKing air, FiberOptic and EXHaust air 1 and 2 openings in both of plates 96 and 200. This constructions effectively seals each of these passageways anytime the two plate 96, 200 are so secured to each other, and permits the quick and easy disconnection, reconnection and, if necessary or desirable, replacement of dispenser 38 with another dispenser of like or similar configuration.

Because the fluidized powder supplied to fitting 96-1 is somewhat penetrating, the configuration of the PowDeR fitting 96-1 of the quick disconnect 96, 200 is somewhat different. Specifically, fitting 96-1 includes a nipple 210 provided with an additional O-ring seal 99. The nipple 210 of fitting 96-1 slides into, and is sealed by this additional O-ring 99 within, a relief 212 provided for the nipple 210 in surface 202 of plate 200. Plate 200 is mounted on any desired type of mounting, such as a stand, reciprocator, or the like, which presents powder bell cup assembly 60 at a suitable position adjacent articles to be coated by powder coating material to be dispensed therefrom.

What is claimed is:

1. A coating dispensing head including a rotary dispensing device for dispensing a fluidized pulverulent coating material, a compressed gas driven turbine rotator for rotating the rotary dispensing device, the head including a first connection for supplying the fluidized pulverulent coating material to the dispensing device and a second connection for supplying compressed gas to the rotator, the first connection including first and second passageways terminating at first and second generally flat surfaces, respectively, the second connection including third and fourth passageways terminating at the first and second surfaces, respectively, and connectors for holding the first and second surfaces against each other with the first and second passageways aligned and the third and fourth passageways aligned so that the fluidized pulverulent material supplied to one of the first and second passageways flows into the other of the first and second passageways and thence to the dispenser and so that compressed gas supplied to one of the third and fourth passageways flows into the other of the third and fourth passageways and thence to the rotator.

2. The apparatus of claim 1 further comprising a groove in one of the first and second surfaces around a respective one of the first and second passageways for accommodating an O-ring to assist in sealing the first and second passageways to each other at the mating first and second surfaces.

3. The apparatus of claim 1 further comprising a tachometer for generating a light signal in response to rotation of the rotator, a first optical fiber having a first end for receiving the light signal and a second end for conducting the light signal to one of the first and second surfaces, fifth and sixth passageways in the first and second surfaces, the connectors holding the first and second surfaces against each other with the fifth and sixth passageways aligned, a first retainer for retaining the second end of the optical fiber in a fixed location in one of the fifth and sixth passageways, means for receiving the light signal from the second end of the optical fiber, and a second retainer for retaining the receiving means in a fixed location in the other of the fifth and sixth passageways.

4. The apparatus of claim 3 further comprising a first groove in one of the first and second surfaces around a respective one of the first and second passageways for accommodating a first O-ring to assist in sealing the first and second passageways to each other at the mating first and second surfaces.

5. The apparatus of claim 4 further comprising a second groove in one of the first and second surfaces around a respective one of the third and fourth passageways for accommodating a second O-ring to assist in sealing the third and fourth passageways to each other at the mating first and second surfaces.

6. The apparatus of claim 1 further comprising a first groove in one of the first and second surfaces around a respective one of the first and second passageways for accommodating a first O-ring to assist in sealing the first and second passageways to each other at the mating first and second surfaces.

7. The apparatus of claim 6 further comprising a second groove in one of the first and second surfaces around a respective one of the third and fourth passageways for accommodating a second O-ring to assist in sealing the third and fourth passageways to each other at the mating first and second surfaces.

8. A coating dispensing head comprising a rotary dispensing device, a rotator for rotating the rotary dispensing device, a first connection for supplying a coating to the dispensing device, a second connection for supplying motive power to the rotator, first and second generally flat surfaces, a tachometer for generating a light signal in response to rotation of the rotator, a first optical fiber having a first end for receiving the light signal and a second end for conducting the light signal to one of the first and second generally flat surfaces, first and second passageways provided in the first and second surfaces, connectors for holding the first and second surfaces against each other with the first and second passageways aligned, a first retainer for retaining the second end of the optical fiber in a fixed location adjacent said one of the first and second surfaces, first means for receiving the light signal from the second end of the optical fiber, and a second retainer for retaining the first means adjacent the other of the first and second surfaces to receive the light signal from the second end of the first optical fiber when the connectors are holding the first and second surfaces against each other.

9. The apparatus of claim 8 wherein the rotary dispensing device comprises a dispenser for fluidized pulverulent coating material and the rotator comprises a compressed gas driven turbine rotator.

* * * * *